US009922777B1

(12) United States Patent
Li et al.

(10) Patent No.: US 9,922,777 B1
(45) Date of Patent: Mar. 20, 2018

(54) VACUUM SWITCHING APPARATUS AND ELECTRICAL CONTACT THEREFOR

(71) Applicant: EATON CORPORATION, Cleveland, OH (US)

(72) Inventors: Wangpei Li, Horseheads, NY (US); Li Yu, Pittsburgh, PA (US); Somasundara Rao Matu, Maharastra (IN)

(73) Assignee: EATON CORPORATION, Cleveland, OH (US)

( * ) Notice: Subject to any disclaimer, the term of this patent is extended or adjusted under 35 U.S.C. 154(b) by 0 days.

(21) Appl. No.: 15/357,148

(22) Filed: Nov. 21, 2016

(51) Int. Cl.

| | |
|---|---|
| ***H01H 1/02*** | (2006.01) |
| ***H01H 33/662*** | (2006.01) |
| ***H01H 33/664*** | (2006.01) |
| ***H01H 33/66*** | (2006.01) |

(52) U.S. Cl.
CPC ..... *H01H 1/0203* (2013.01); *H01H 33/6606* (2013.01); *H01H 33/6643* (2013.01); *H01H 33/66207* (2013.01); *H01H 2033/66223* (2013.01)

(58) Field of Classification Search
CPC ..... H01H 33/6606; H01H 33/6643; H01H 33/6644; H01H 33/664; H01H 33/6645; H01H 33/6646; H01H 1/0203
USPC ..... 218/140, 123, 127, 128, 129, 146, 48, 218/126
See application file for complete search history.

(56) References Cited

U.S. PATENT DOCUMENTS

| | | | |
|---|---|---|---|
| 2,949,520 | A | 8/1960 | Schneider |
| 3,089,936 | A | 5/1963 | Smith, Jr. |
| 3,522,399 | A | 7/1970 | Crouch |
| 3,809,836 | A | 5/1974 | Crouch |
| 3,836,740 | A | 9/1974 | Hundstad |
| 4,390,762 | A | 6/1983 | Watzke |
| 4,445,015 | A | 4/1984 | Zueckler |
| 4,553,002 | A | 11/1985 | Slade |
| RE32,116 | E | 4/1986 | Griesen |

(Continued)

FOREIGN PATENT DOCUMENTS

| | | |
|---|---|---|
| FR | 2 969 367 A1 | 6/2012 |
| JP | S57 74920 A | 5/1982 |
| JP | 2012 119254 A | 6/2012 |

OTHER PUBLICATIONS

Translation JP 2012-119254 (original doc. published Jun. 21, 2012).*

(Continued)

*Primary Examiner* — Renee Luebke
*Assistant Examiner* — William Bolton
(74) *Attorney, Agent, or Firm* — Eckert Seamans; John Powers; Grant Coffield

(57) ABSTRACT

An electrical contact for a vacuum switching apparatus. The vacuum switching apparatus includes a second electrical contact. The electrical contact includes a hub portion and a plurality of petal portions each extending from the hub portion. Each of the plurality of petal portions has a first surface and a second surface. The first surface faces in a first direction and is structured to engage the second electrical contact. The second surface faces in a second direction generally opposite the first direction. At least one of the plurality of petal portions further has a grooved portion extending inwardly from the second surface toward the first surface.

16 Claims, 6 Drawing Sheets

(56) References Cited

U.S. PATENT DOCUMENTS

| | | | | |
|---|---|---|---|---|
| 4,588,879 | A * | 5/1986 | Noda | H01H 33/6644 218/127 |
| 4,636,600 | A | 1/1987 | Lipperts | |
| 4,675,482 | A | 6/1987 | Bialkowski | |
| 4,717,797 | A | 1/1988 | Hoene | |
| 4,806,714 | A * | 2/1989 | Aoki | H01H 33/6643 218/129 |
| 5,438,174 | A * | 8/1995 | Slade | H01H 33/6644 218/118 |
| 5,444,201 | A | 8/1995 | Schulman et al. | |
| 5,804,788 | A | 9/1998 | Smith | |
| 6,080,952 | A | 6/2000 | Okutomi et al. | |
| 7,173,208 | B2 * | 2/2007 | Harada | H01H 33/6644 218/123 |
| 7,721,428 | B2 | 5/2010 | Stoving et al. | |
| 9,040,862 | B2 * | 5/2015 | Ryu | H01H 33/6643 218/123 |
| 2002/0144977 | A1 | 10/2002 | Kikuchi et al. | |
| 2012/0091102 | A1 * | 4/2012 | Kim | H01H 33/6643 218/128 |

OTHER PUBLICATIONS

Translation JPS 5774920 (original doc. published May 11, 1982).*
European Patent Office, "International Search Report and Written Opinion", PCT/US2016/047449, dated Oct. 26, 2016, 12 pp.
Notice of Allowance dated Nov. 10, 2016 and Cited References by Examiner. U.S. Appl. No. 14/833,197, filed Aug. 24, 2015.

* cited by examiner

VACUUM SWITCHING APPARATUS AND ELECTRICAL CONTACT THEREFOR

BACKGROUND

Field

The disclosed concept relates to vacuum switching apparatus such as, for example, vacuum switches including a vacuum envelope such as, for example, vacuum interrupters. The disclosed concept also pertains to electrical contacts for vacuum interrupters.

Background Information

Vacuum interrupters include separable main contacts located within an insulated and hermetically sealed vacuum chamber. The vacuum chamber typically includes, for example and without limitation, a number of sections of ceramics (e.g., without limitation, a number of tubular ceramic portions) for electrical insulation capped by a number of end members (e.g., without limitation, metal components, such as metal end plates; end caps; seal cups) to form an envelope in which a partial vacuum may be drawn. The example ceramic section is typically cylindrical; however, other suitable cross-sectional shapes may be used. Two end members are typically employed. Where there are multiple ceramic sections, an internal center shield is disposed between the example ceramic sections. Some known vacuum interrupters include a radial magnetic field generating mechanism such as, for example and without limitation, a spiral electrical contact or a contrate cup, designed to force rotation of the arc column between the pair of electrical contacts interrupting a high current, thereby spreading the arcing duty over a relatively wide area. These vacuum interrupters suffer from a number of disadvantages. For example, the electrical contacts typically experience a large number of mechanical operating cycles at high speeds and at high forces. Both force and speed contribute to the momentum and the energy of impact of the electrical contacts during opening and closing. A high opening speed is desirable for faster separation between the electrical contacts to help the dielectric recovery strength between the electrical contacts. A high closing speed is desirable for minimizing the prestrike arcing and subsequent welding together as the electrical contacts close on each other under a voltage. A high speed is necessary for a high voltage and a high force is necessary for a high current.

When the opening and/or closing speed is high and the contact force on closing is large as needed for high fault currents, the individual petals of the electrical contact often undesirably fracture and break off from the rest of the electrical contact. Known remedies to prevent the premature breaking of the petals include making the electrical contact thicker, machining the peripheral portion of the electrical contact thinner by tapering the electrical contact on one or both sides, and adding a mechanical support to the underside of the petals. Making the electrical contact thicker increases the cost of the contact material and also results in current flow being not as heavily concentrated towards the arcing surface, thereby reducing the transverse magnetic field. Tapering the electrical contact limits the maximum values of radii of the edges on the outside diameter of the electrical contacts, thereby adversely affecting the contact's dielectric performance. Finally, adding a mechanical support not only adds to the cost of the vacuum interrupter, but also complicates design and manufacturing. More specifically, if the support is not mechanically joined (e.g., via brazing) to the petals, it will only minimize flexing of the petals in a direction towards the support, but not in an opposing direction away from the support. If the support is mechanically joined to the petals, it will electrically bridge the slots machined into the electrical contact unless cuts are also made into the support, a process which would undesirably weaken the mechanical strength of the support.

There is thus room for improvement in vacuum switching apparatus and in electrical contacts therefor.

SUMMARY

These needs and others are met by embodiments of the disclosed concept, which are directed to a vacuum switching apparatus and electrical contact therefor.

In accordance with one aspect of the disclosed concept, an electrical contact for a vacuum switching apparatus is provided. The vacuum switching apparatus includes a second electrical contact. The electrical contact includes a hub portion and a plurality of petal portions each extending from the hub portion. Each of the plurality of petal portions has a first surface and a second surface. The first surface faces in a first direction and is structured to engage the second electrical contact. The second surface faces in a second direction generally opposite the first direction. At least one of the plurality of petal portions further has a grooved portion extending inwardly from the second surface toward the first surface.

As another aspect of the disclosed concept, a vacuum switching apparatus including the aforementioned electrical contact is provided.

BRIEF DESCRIPTION OF THE DRAWINGS

A full understanding of the disclosed concept can be gained from the following description of the preferred embodiments when read in conjunction with the accompanying drawings in which.

DESCRIPTION OF THE PREFERRED EMBODIMENTS

As employed herein, the term "number" shall mean one or an integer greater than one (i.e., a plurality).

As employed herein, the statement that two or more parts are "connected" or "coupled" together shall mean that the parts are joined together either directly or joined through one or more intermediate parts.

As employed herein, the statement that two or more parts or components "engage" one another shall mean that the parts touch and/or exert a force against one another either directly or through one or more intermediate parts or components.

As employed herein, the term "grooved portion" shall mean an area, portion, or segment of a structure, such as an electrical contact in accordance with the disclosed concept, wherein material has been removed or which is otherwise devoid of material, or has a reduced amount of material in comparison with other areas, portions or segments of the structure, and shall expressly include but not be limited to, a slot, a thinned portion, a blind hole, a void, a hollowed space, a recess, or a combination of the foregoing in any suitable number and configuration.

Figure 1:
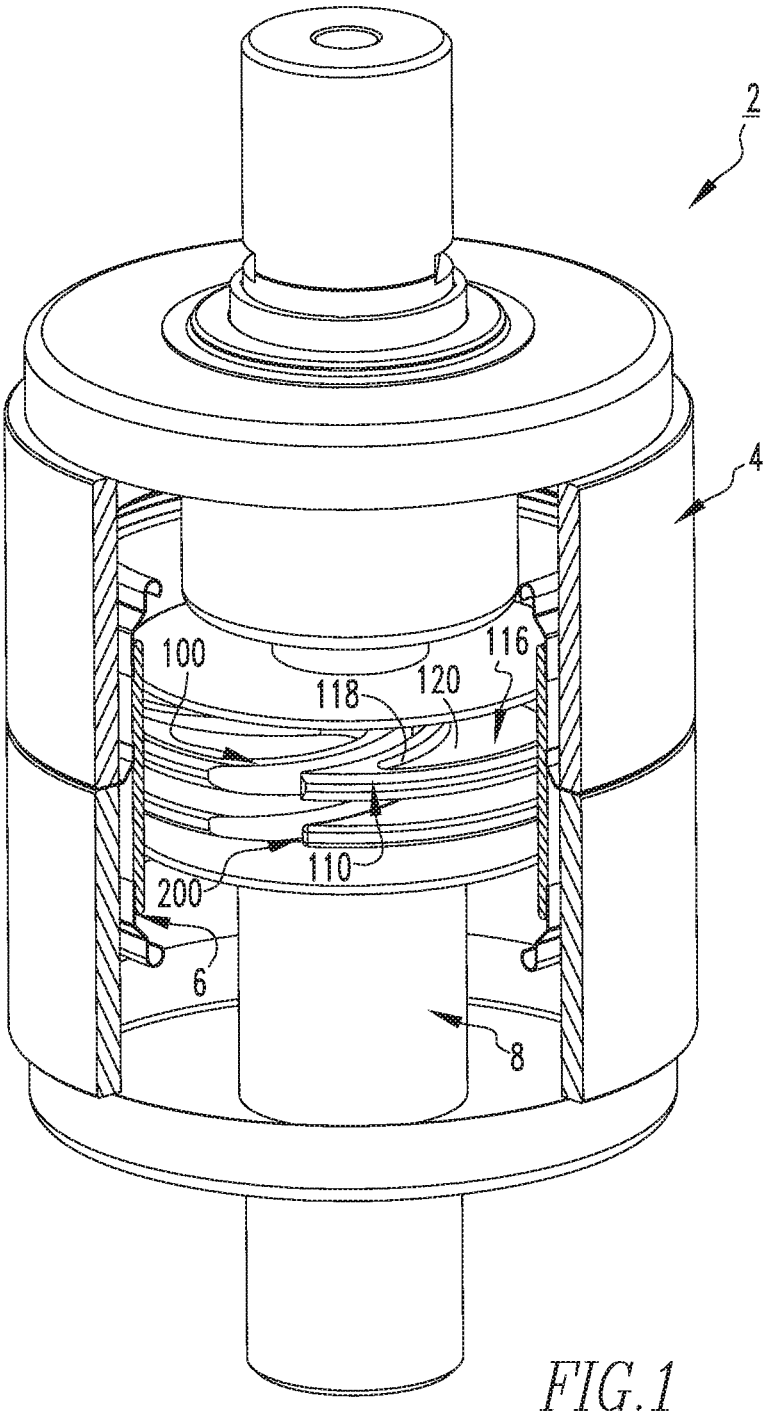
FIG. 1 is a partial section view of a vacuum switching apparatus and electrical contact therefor, in accordance with a non-limiting embodiment of the disclosed concept.
Figure 2:
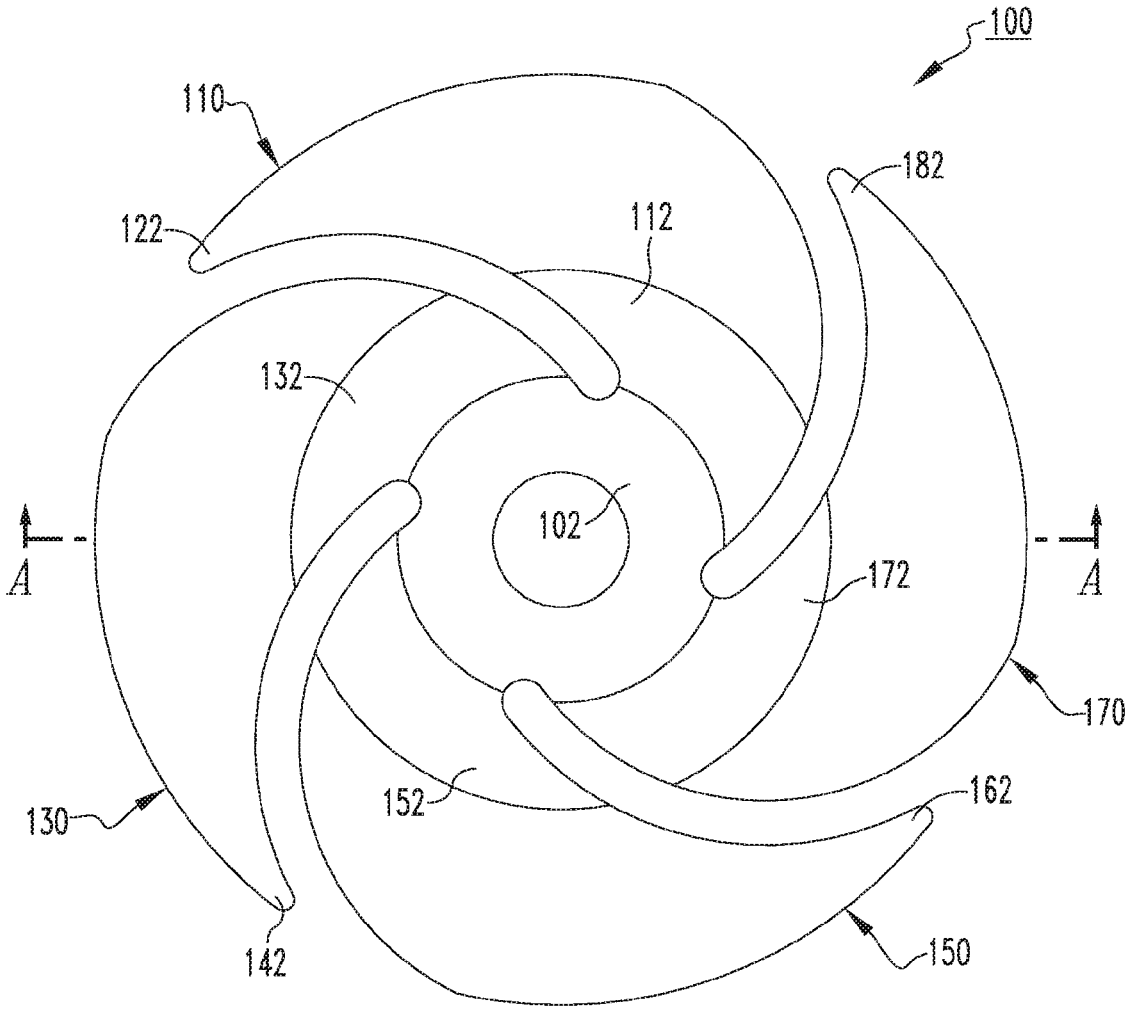
FIG. 2 is a top plan view of one of the electrical contacts of FIG. 1.

FIG. 1 shows a vacuum switching apparatus (e.g., without limitation, vacuum interrupter 2) that includes a tubular ceramic member 4, a tubular vapor shield 6 located internal the ceramic member 4, and a pair of separable electrical contacts 100,200 located internal the vapor shield 6. The electrical contacts 100,200 are spiral contacts that are structured to move into and out of engagement with each other in order to close and open the vacuum interrupter 2. FIG. 2 shows a top plan view of the electrical contact 100. As shown, the electrical contact 100 includes a hub portion 102 and a plurality of petal portions 110,130,150,170 extending from the hub portion 102. As will be discussed in greater detail below, the electrical contact 100 provides a number of novel advantages for the vacuum interrupter 2, as compared to prior art electrical contacts (not shown). Among other benefits, the petal portions 110,130,150,170 of the electrical contact 100 have a substantially reduced likelihood of breaking off during operation of the vacuum interrupter 2, as compared to prior art electrical contacts (not shown). Furthermore, the electrical contact 100 advantageously increases current interruption capabilities by forcing more current flow toward the arcing surfaces and conducting heat away from the arc root. In one non-limiting embodiment of the disclosed concept, the electrical contact 200 (FIG. 1) is structured as a mirror image of the electrical contact 100. However, for economy of disclosure, only the electrical contact 100 will be described in detail herein. It will be appreciated that one or both of the electrical contacts 100, 200 can include any known or suitable grooved portion or combination of grooved portions, in accordance with the disclosed concept.

Continuing to refer to FIG. 2, each of the petal portions 110,130,150,170 includes respective first surfaces 112,132, 152,172. When installed in the vacuum interrupter 2, the first surfaces 112,132,152,172 face in a direction toward the electrical contact 200 and move into and out of engagement with the electrical contact 200 to close and open the vacuum interrupter 2. Because the vacuum interrupter 2 experiences relatively high forces associated with closing and opening of the electrical contacts 100,200, it is desirable for the electrical contacts 100,200 to be able to withstand the energy of impact associated with such closing and opening. In order to achieve this aim, the petal portions 110,130,150,170 each have a novel geometry, as shown more clearly in FIGS. 3 and 4.

Figure 3:
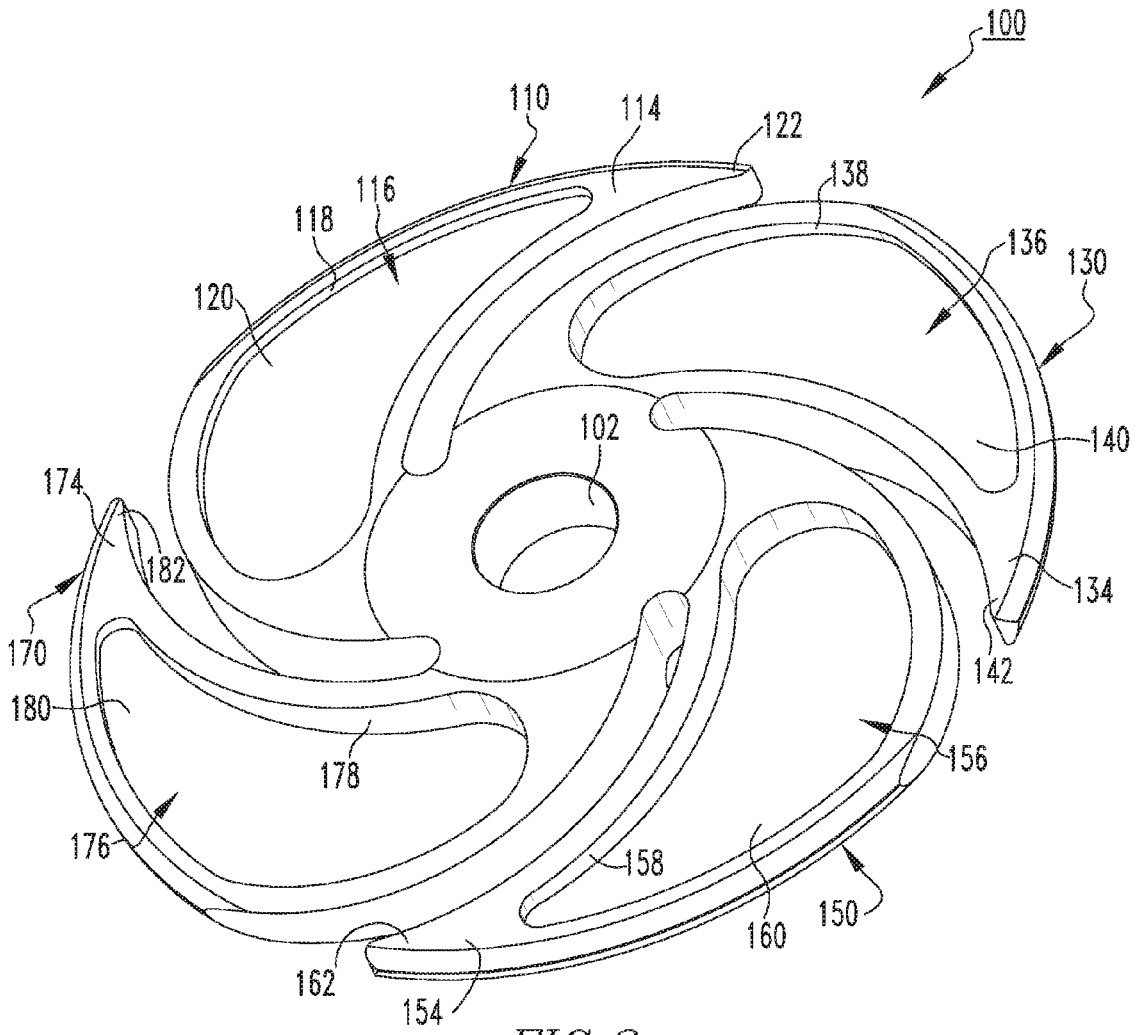
FIG. 3 is a bottom isometric view of the electrical contact of FIG. 2.

FIG. 3 shows a bottom isometric view of the electrical contact 100. As shown, each of the petal portions 110,130, 150,170 further has a respective second surface 114,134, 154,174 extending from the hub portion 102. It will be appreciated that the second surfaces 114,134,154,174 each face in a second direction generally opposite the direction which the first surfaces 112,132,152,172 face. The petal portions 110,130,150,170 each have a grooved portion 116, 136,156,176 extending inwardly from the respective second surface 114,134,154,174 toward the respective first surface 112,132,152,172. In other words, each of the petal portions 110,130,150,170 has a void, or hollowed out region, on a rear portion thereof (i.e., a portion facing away from the opposing electrical contact 200 (FIG. 1)). The grooved portions 116,136,156,176 each have respective third surfaces 118,138,158,178 and respective fourth surfaces 120, 140,160,180 extending from the third surfaces 118,138,158, 178. In the instant exemplary embodiment, the third surfaces 118,138,158,178 are perpendicular to the fourth surfaces 120,140,160,180, and extend inwardly from the second surfaces 114,134,154,174. Thus, it will be appreciated that the grooved portions 116,136,156,176 can be machined by a relatively simple milling operation. It will also be appreciated that the electrical contact 100, or a similar suitable alternative electrical contact (e.g., without limitation, an electrical contact with third surfaces not being perpendicular to fourth surfaces, not shown) can be cast or formed such that no additional machining of grooved portions is required.

Figure 4:
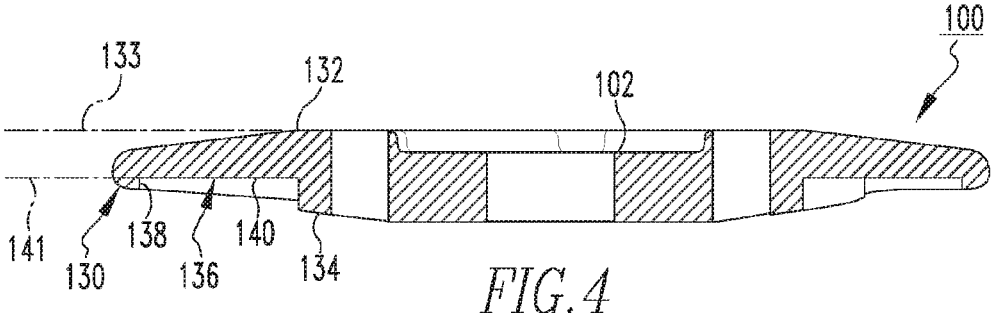
FIG. 4 is a section view of the electrical contact of FIG. 2, taken along line A-A of FIG. 2.

FIG. 4 shows a section view of the electrical contact 100. For economy of disclosure only the petal portion 130 will be discussed in detail, although it will be appreciated that the petal portions 110,150,170 are structured and function the same as the petal portion 130. The first surface 132 is located in a plane 133 and the fourth surface 140 is located in another plane 141 parallel to the plane 133. The plane 141 is also located between the plane 133 and the second surface 134. In one embodiment the plane 141 is located generally midway between the plane 133 and the second surface 134. The second surface 134 is spaced from the plane 133. The third surface 138 is located perpendicular to the plane 133. Accordingly, the grooved portion 136 extends a substantial distance into the interior of the electrical contact 100, thereby substantially reducing the mass of the electrical contact 100, as compared to prior art electrical contacts (not shown). Referring again to FIG. 3, each of the petal portions 110,130,150,170 has a respective distal portion 122,142, 162,182 located opposite the hub portion 102. In the instant exemplary embodiment, each respective fourth surface 120, 140,160,180 extends from proximate the hub portion 102 to proximate the respective distal portion 122,142,162,182, thereby further reducing the mass of the electrical contact 100.

As mentioned above, the electrical contact 100 provides a novel mechanism to substantially reduce the likelihood of the petal portions 110,130,150,170 breaking off from the hub portion 102 during operation of the vacuum interrupter 2 (FIG. 1). More specifically, by having a reduced mass, the electrical contact 100 moves with less momentum (i.e., momentum equals mass times velocity) than prior art electrical contacts (not shown). Accordingly, when the electrical contact 100 changes directions, either by impacting an electrical contact during closing or by moving away from an electrical contact during opening, the electrical contact 100 will oscillate significantly less than prior art electrical contacts (not shown) which have greater masses. As a result, the potential for breakage of the petal portions 110,130,150,170 resulting from such oscillations is advantageously reduced. Thus, the life of the electrical contact 100 is able to be lengthened, as the electrical contacts will move with a relatively fixed position, as compared to prior art electrical contacts (not shown).

Furthermore, because the mass of the electrical contact 100 is more heavily concentrated on the arcing surfaces (i.e., the first surfaces 112,132,152,172 and portions of the petal portions 110,130,150,170 extending therefrom to the distal portions 122,142,162,182) by virtue of the novel grooved portions 116,136,156,176, it necessarily follows that the current flow from the hub portion 102 to the distal portions 122,142,162,182, where the root of the running arc column is during current interruption, will likewise be more heavily concentrated toward the arcing surfaces (i.e., the first surfaces 112,132,152,172 and portions of the petal portions 110,130,150,170 extending therefrom to the distal portions 122,142,162,182). This strengthens the transverse magnetic field that drives spinning of the columnar arc and increases the interruption performance of the vacuum interrupter 2 (FIG. 1). Additionally, because the electrical contact 100 has a reduced mass in the petal portions 110,130,150,170, heat is advantageously conducted away from the arcing surfaces (i.e., the first surfaces 112,132,152,172 and portions of the petal portions 110,130,150,170 extending therefrom to the distal portions 122,142,162,182) in a shorter time.

Figure 5:
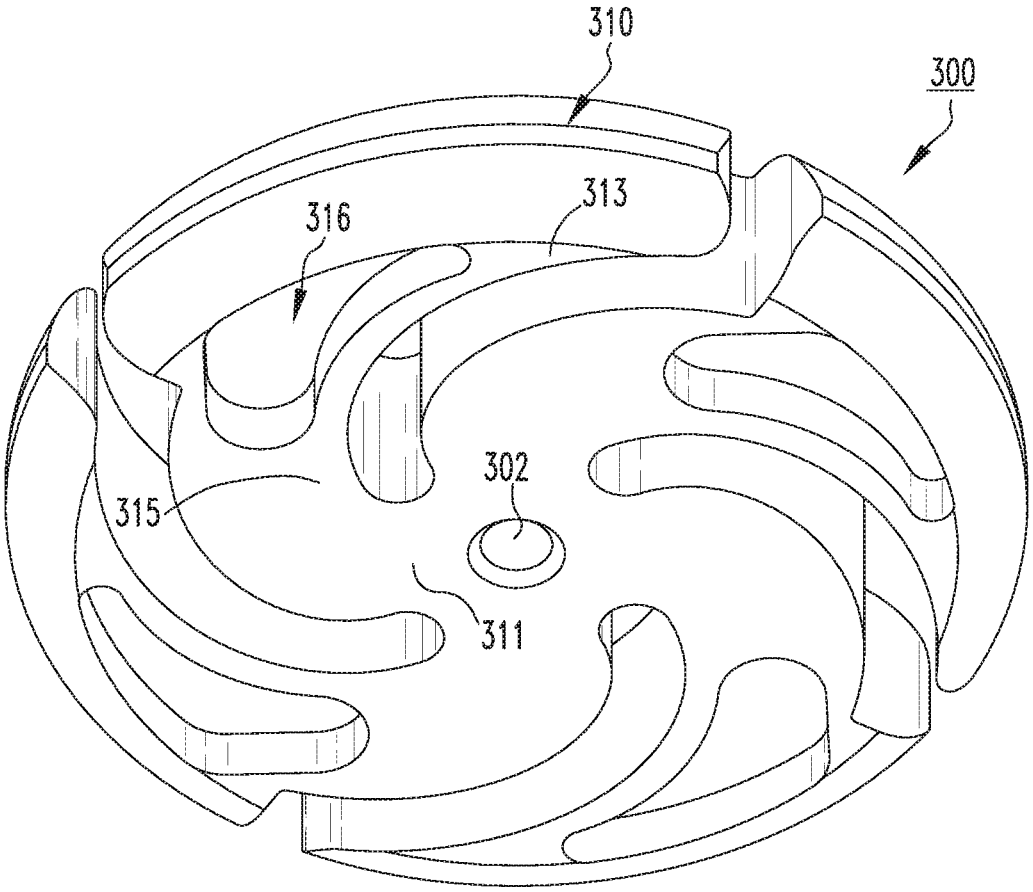
FIG. 5 is a bottom isometric view of another electrical contact, in accordance with another non-limiting embodiment of the disclosed concept.
Figure 6:
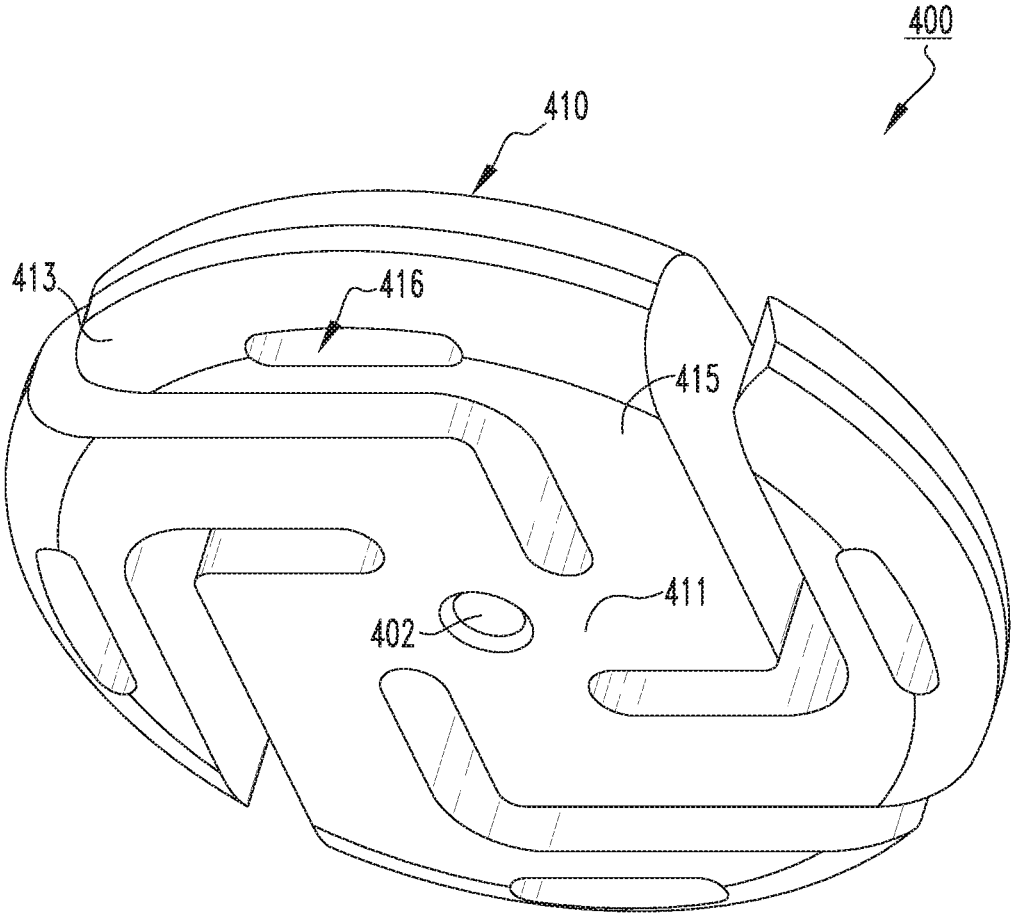
FIG. 6 is a bottom isometric view of another electrical contact, in accordance with another non-limiting embodiment of the disclosed concept.

FIGS. 5 and 6 show other electrical contacts 300,400 of different slot designs each of which may be substituted into the vacuum interrupter 2 (FIG. 1) in place of either, or both, of the electrical contacts 100,200 (FIG. 1) and/or in any suitable combination, in accordance with other non-limiting embodiments of the disclosed concept. As shown, each of the electrical contacts 300,400 has a respective hub portion 302,402 and a respective plurality of petal portions (only petal portions 310,410 are numbered) extending from the hub portions 302,402. The petal portions 310,410 have opposing respective end portions 311,313,411,413 and respective midpoints 315,415 between the end portions 311,313,411,413. The first end portions 311,411 extend from the respective hub portions 302,402. Furthermore, as shown, each of the petal portions 310,410 has a respective grooved portion 316,416 located between the respective midpoints 315,415 and the respective second end portions 313,413. The grooved portions 316,416 function the same as the grooved portions 116,136,156,176 of the electrical contact 100, discussed above. However, by locating the grooved portions 316,416 between the respective midpoints 315,415 and the respective second end portions 313,413, electrodes (see, for example, electrode 8, shown in FIG. 1) advantageously have a larger portion of the electrical contacts 300,400 to mate with and thereby be better secured to.

Figure 7:
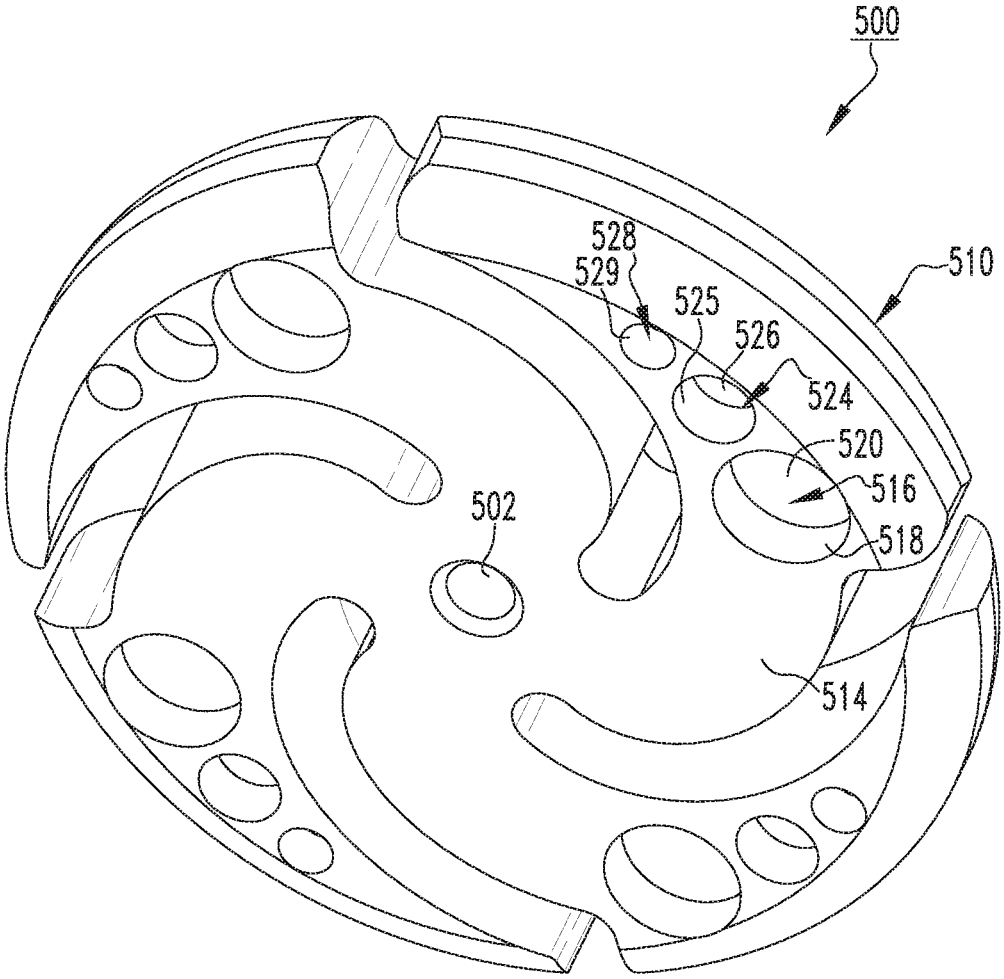
FIG. 7 is a bottom isometric view of another electrical contact, in accordance with another non-limiting embodiment of the disclosed concept.

FIG. 7 shows another electrical contact 500 that may be substituted into the vacuum interrupter 2 (FIG. 1) in place of either of the electrical contacts 100,200 (FIG. 1), in accordance with another non-limiting embodiment of the disclosed concept. As shown, the electrical contact 500 has a hub portion 502 and a plurality of petal portions (only petal portion 510 is numbered) extending from the hub portion 502. The petal portion 510 has a plurality of grooved portions 516,524,528 each extending inwardly from a second surface 514 toward a first surface (not shown in FIG. 7). As shown, each of the grooved portions 516,524,528 has a respective cylindrical-shaped surface 518,525,529 extending inwardly from the second surface 514 toward the first surface, and another respective surface (two of the three surfaces 520,526 are shown) extending from the cylindrical-shaped surface 518,525,529. Accordingly, it will be appreciated that grooved portions, such as the grooved portions 516,524,528, can be relatively easily machined with a conventional drill. It will also be appreciated that an electrical contact, such as the electrical contact 500, can have any suitable number of grooved portions extending inwardly from a second surface of a petal portion, without departing from the scope of the disclosed concept.

It will also be appreciated that the disclosed concept of providing a grooved portion on a rear side of an electrical contact may be employed with any suitable spiral type transverse magnetic field electrical contact design and geometry, in addition to the electrical contacts 100,200,300,400,500 described herein.

Accordingly, the disclosed concept provides for an improved (e.g., without limitation, better protected against petal breakage, better able to interrupt current and dissipate heat away from an arcing surface) vacuum switching apparatus 2 and electrical contact 100,200, 300,400,500 therefor, in which a petal portion 110,130,150,170,310,410,510 has a number of grooved portions 116,136,156,176,316,416,516,524,528 provided therein. The grooved portions 116,136,156,176,316,416,516,524,528 advantageously reduce the overall mass of the respective petal portions 110,130,150,170,310, preferably at a periphery thereof where oscillation is most likely to occur during opening and closing. In this manner, oscillation of the petal portions 110,130,150,170,310,410,510, a primary cause of fracture, is significantly reduced. Furthermore, because the electrical contacts 100,200,300,400,500 have a reduced mass, heat is advantageously conducted away from arcing surfaces 112,132,152,172 in a shorter time.

While specific embodiments of the disclosed concept have been described in detail, it will be appreciated by those skilled in the art that various modifications and alternatives to those details could be developed in light of the overall teachings of the disclosure. Accordingly, the particular arrangements disclosed are meant to be illustrative only and not limiting as to the scope of the disclosed concept which is to be given the full breadth of the claims appended and any and all equivalents thereof.

What is claimed is:

1. An electrical contact for a vacuum switching apparatus, said vacuum switching apparatus comprising a second electrical contact, said electrical contact comprising:

a hub portion; and a plurality of petal portions each extending from said hub portion, each of said plurality of petal portions comprising a first surface and a second surface, the first surface facing in a first direction and being structured to engage said second electrical contact, the second surface facing in a second direction generally opposite the first direction, wherein at least one of said plurality of petal portions further has a grooved portion extending inwardly from the second surface toward the first surface; wherein said at least one of said plurality of petal portions further has a first end portion, a second end portion disposed opposite the first end portion, and a midpoint disposed between the first end portion and the second end portion; wherein the first end portion extends from the hub portion; and wherein the grooved portion is generally disposed between the midpoint and the second end portion.

2. The electrical contact of claim 1 wherein the first surface is disposed in a plane; wherein the second surface is spaced from the plane; wherein the grooved portion has a third surface extending inwardly from the second surface; and wherein the third surface is disposed perpendicular to the plane.

3. The electrical contact of claim 2 wherein the grooved portion further has a fourth surface extending from the third surface; wherein the fourth surface is disposed in another plane; and wherein the another plane is disposed between the plane and the second surface.

4. The electrical contact of claim 3 wherein the another plane is disposed generally midway between the plane and the second surface.

5. The electrical contact of claim 1 wherein said at least one of said plurality of petal portions is each of said plurality of petal portions.

6. The electrical contact of claim 1 wherein said at least one of said plurality of petal portions further has a number of other grooved portions each extending inwardly from the second surface toward the first surface.

7. The electrical contact of claim 6 wherein the grooved portion and the number of other grooved portions each have a cylindrical-shaped surface extending inwardly from the second surface toward the first surface.

8. A vacuum switching apparatus comprising:

a first electrical contact; and a second electrical contact comprising:

a hub portion, and a plurality of petal portions each extending from said hub portion, each of said plurality of petal portions comprising a first surface and a second surface, the first surface facing in a first direction and being structured to engage said first electrical contact, the second surface facing in a second direction generally opposite the first direction, wherein at least one of said plurality of petal portions further has a grooved portion extending inwardly from the second surface toward the first surface; wherein said at least one of said plurality of petal portions further has a first end portion, a second end portion disposed opposite the first end portion, and a midpoint disposed between the first end portion and the second end portion; wherein the first end portion extends from the hub portion; and wherein the grooved portion is generally disposed between the midpoint and the second end portion.

9. The vacuum switching apparatus of claim 8 wherein the first surface is disposed in a plane; wherein the second surface is spaced from the plane; wherein the grooved portion has a third surface extending inwardly from the second surface; and wherein the third surface is disposed perpendicular to the plane.

10. The vacuum switching apparatus of claim 9 wherein the grooved portion further has a fourth surface extending from the third surface; wherein the fourth surface is disposed in another plane; and wherein the another plane is disposed between the plane and the second surface.

11. The vacuum switching apparatus of claim 10 wherein the another plane is disposed generally midway between the plane and the second surface.

12. The vacuum switching apparatus of claim 8 wherein said at least one of said plurality of petal portions is each of said plurality of petal portions.

13. The vacuum switching apparatus of claim 8 wherein said at least one of said plurality of petal portions further has a number of other grooved portions each extending inwardly from the second surface toward the first surface.

14. The vacuum switching apparatus of claim 13 wherein the grooved portion and the number of other grooved portions each have a cylindrical-shaped surface extending inwardly from the second surface toward the first surface.

15. The vacuum switching apparatus of claim 8 wherein said first electrical contact comprises:

a hub portion, and a plurality of petal portions each extending from said hub portion of said first electrical contact, each of said plurality of petal portions of said first electrical contact comprising a third surface and a fourth surface, the third surface facing in a third direction and being structured to engage said second electrical contact, the fourth surface facing in a fourth direction opposite the third direction, wherein at least one of said plurality of petal portions of said first electrical contact further has a grooved portion extending inwardly from the fourth surface toward the third surface.

16. The vacuum switching apparatus of claim 15 wherein said vacuum switching apparatus further comprises a tubular ceramic member and a tubular vapor shield disposed internal said tubular ceramic member; wherein said first electrical contact and said second electrical contact are disposed internal said tubular vapor shield; and wherein said vacuum switching apparatus is a vacuum interrupter.

* * * * *